US009459588B2

(12) United States Patent
Kobayashi

(10) Patent No.: US 9,459,588 B2
(45) Date of Patent: Oct. 4, 2016

(54) IMAGE FORMING DEVICE HAVING A MECHANISM FOR COOLING A CIRCUIT BOARD

(71) Applicant: KYOCERA Document Solutions Inc., Osaka (JP)

(72) Inventor: Tatsuya Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/786,533

(22) PCT Filed: May 21, 2014

(86) PCT No.: PCT/JP2014/063438

§ 371 (c)(1),
(2) Date: Oct. 22, 2015

(87) PCT Pub. No.: WO2015/029510

PCT Pub. Date: Mar. 5, 2015

(65) Prior Publication Data

US 2016/0070231 A1 Mar. 10, 2016

(30) Foreign Application Priority Data

Aug. 26, 2013 (JP) ..... 2013-175052

(51) Int. Cl.
*G03G 21/00* (2006.01)
*G03G 21/20* (2006.01)

(52) U.S. Cl.
CPC ..... *G03G 21/206* (2013.01)

(58) Field of Classification Search
CPC ..... G03G 21/20; G03G 21/206
USPC ..... 399/92, 94
See application file for complete search history.

(56) References Cited

U.S. PATENT DOCUMENTS 6,205,302 B1 * 3/2001 Yokota ..... G03G 21/206 399/92 X
7,558,060 B2 * 7/2009 Kiyosumi ..... B41J 29/377 399/92 X
2010/0215393 A1 * 8/2010 Sasaki ..... G03G 15/5004 399/88
2013/0107456 A1 * 5/2013 Kitajima ..... G03G 21/206 361/695
2013/0251385 A1 * 9/2013 Mitourida ..... G03G 21/206 399/92 X
2013/0259511 A1 * 10/2013 Koyama ..... G03G 21/206 399/92

FOREIGN PATENT DOCUMENTS

JP 2003-316237 A 11/2003
JP 2004-233452 A 8/2004

(Continued)

OTHER PUBLICATIONS

International Search Report dated Jul. 8, 2014, issued to International Application No. PCT/JP2014/063438.

*Primary Examiner* — Sophia S Chen
(74) *Attorney, Agent, or Firm* — Stein IP, LLC

(57) ABSTRACT

In the present invention, in order to efficiently cool circuit boards such as an image formation section (20) and a power source board (71) accommodated in a main body housing (60), the power source board (71) and a cooling fan (100) are attached to a lateral wall part (62*a*) adjacent to the image formation section (20) in the main body housing (60), and the cooling fan (100) cools the image formation section (20) and the power source board (71) by utilizing air flow generated by rotation.

15 Claims, 9 Drawing Sheets

(56) References Cited

FOREIGN PATENT DOCUMENTS

| | | | |
|---|---|---|---|
| JP | 2005-17939 | A | 1/2005 |
| JP | 2008-70744 | A | 3/2008 |
| JP | 2009-122452 | A | 6/2009 |
| JP | 2009-294621 | A | 12/2009 |

* cited by examiner

IMAGE FORMING DEVICE HAVING A MECHANISM FOR COOLING A CIRCUIT BOARD

CROSS-REFERENCE TO RELATED APPLICATIONS

This application is a national stage of International Application No. PCT/JP2014/063438, filed May 21, 2014, which claims the benefit of priority of Japanese Application No. 2013-175052, filed Aug. 26, 2013, in the Japanese Patent Office, the disclosures of which are incorporated herein by reference.

TECHNICAL FIELD

The present disclosure relates to an image forming device.

BACKGROUND ART

Conventionally, an image forming device is known, in which air is inhaled into an image forming device main body by means of a cooling fan; and the inhaled air cools portions to be cooled such as an image forming portion, a power source board and the like that are housed in the device main body (e.g., see a patent document 1). In this device, a right wall portion of the image forming device main body is provided with an air inhaling opening. The air inhaling opening is connected to a duct in which cooling air flows, and the cooling fan is disposed in the duct. The image forming portion is disposed near a left wall portion in the image forming device main body and a downstream-side end portion of the duct is opened near the image forming portion. And, the image forming portion is cooled by an airflow blown out from the downstream-side end portion of the duct. On the other hand, the power source board is disposed below the duct. And, the power source board is cooled by an airflow blown out from a branch opening formed through a portion of the duct.

CITATION LIST

Patent Literature

PLT1: JP-A-2003-316237

SUMMARY OF INVENTION

Technical Problem

However, in the conventional image forming device disclosed in the above patent document 1, it is necessary to guide the air flow from the air inhaling opening formed through the right wall portion of the device main body to the image forming portion disposed near the left wall portion. Accordingly, the total length of the duct becomes long. Because of this, there is a problem that the air flow inhaled from the air inhaling opening becomes warm during a time the air flow flows in the duct; and it is impossible to efficiently cool the portions to be cooled such as the image forming portion, the power source board and the like. Besides, there is a problem that the material cost used for the duct becomes high because the total length of the duct is long.

Accordingly, it is conceivable that a cooling fan for cooling the power source board is further disposed besides the cooling fan for cooling the image forming portion. In this way, it is possible to shorten the duct length extending from each cooling fan to the portions (image forming portion, power source board) to be cooled and thereby improve cooling efficiency.

However, in this case, there is a problem that the production cost increases all the more because the number of cooling fans increases. Besides, there is also a problem that because the number of fans increases, the fan noise becomes loud.

The present disclosure has been made in light of the above points, and it is an object of the present disclosure to efficiently cool the image forming portion and the boards by means of an inexpensive structure.

Solution to Problem

An image forming device according to the present disclosure includes: a main body housing portion that houses an image forming portion which records an image onto a sheet; a board; and a cooling fan for cooling the image forming portion and the board.

And, both the board and the cooling fan are mounted on a side wall portion of the main body housing portion adjacent to the image forming portion, and the cooling fan is configured to cool the image forming portion and the board by means of an airflow generated by rotation of the cooling fan.

According to this structure, because the cooling fan is mounted on the side wall portion adjacent to the image forming portion, it is possible to remove the duct for guiding the airflow generated by the rotation of the cooling fan or to shorten the duct length. Therefore, it is possible to improve the cooling efficiency for the image forming portion. Besides, because the board is mounted on the side wall portion, it is possible remove the duct for supplying the airflow generated by the rotation of the cooling fan to the board or to shorten the duct length. Therefore, it is possible to improve the cooling efficiency for the board. Besides, according to the above structure, because it is unnecessary to increase the number of cooling fans, it is possible to curb the production cost and the fan noise.

It is preferable that the cooling fan includes a fan casing mounted on the side wall portion and an impeller that is housed in the fan casing and rotates to make the airflow flow into the casing from outside the main body housing portion, and the fan casing includes: an air inflow opening; a first blow-out opening for blowing out part of the airflow flowing into the casing from the air inflow opening to the image forming portion; and a second blow-out opening for blowing out part of the airflow flowing into the casing from the air inflow opening to the board.

According to this structure, when the impeller rotates, the airflow flows into the casing from outside the main body housing portion through the air inflow opening of the fan casing. Part of the airflow flowing into the casing is blown out from the first blow-out opening to the above image forming portion. And, the image forming portion is cooled by the blown-out airflow. Besides, part of the airflow flowing into the casing is blown out from the second blow-out opening to the above power source board. And, the power source board is cooled by the blown-out airflow.

It is preferable that the image forming portion includes a photosensitive drum that carries an electrostatic latent image; the side wall portion is located in one side in a shaft direction of the photosensitive drum in the main body housing portion; and the first blow-out opening of the fan casing is configured to blow out part of the airflow flowing into the casing from the air inflow opening to one end portion in the shaft direction of the photosensitive drum or to a portion near the one end portion.

According to this structure, the impeller rotates, whereby part of the airflow flowing into the fan casing is blown out through the first blow-out opening to the one end portion in the shaft direction of the above photosensitive drum or to the portion near the one end portion. The blown-out airflow flows from one side to the other side in the shaft direction along a surface of the photosensitive drum. Accordingly, unlike the conventional, it is possible to efficiently cool the entire image forming portion including the photosensitive drum without using the long duct.

Further, it is preferable that the one end portion in the shaft direction of the photosensitive drum is connected to a drive mechanism for driving the photosensitive drum.

According to this structure, it is possible to cool the drive mechanism for the photosensitive drum by means of the airflow that is blown out through the first blow-out opening of the fan casing to the one end portion in the shaft direction of the photosensitive drum. Therefore, it is unnecessary to additionally dispose a cooling fan for cooling the drive mechanism and dispose a long duct for guiding the airflow to the drive mechanism. Therefore, it is possible to improve the cooling efficiency and achieve the low cost.

The image forming device includes an outer cover that covers the side wall portion from outside the image forming device and is provided with an air inhaling portion. And, it is preferable that a gap is formed between the side wall portion and the outer cover; and the board and the cooling fan are mounted on a surface of the side wall portion near the outer cover.

According to this structure, an operator can gain access to the above board and the cooling fan by only removing the outer cover. Therefore, it is possible to improve maintenance characteristics of the image forming device.

It is preferable that the image forming device further includes another board for supplying a high voltage to the image forming portion; wherein the another board is mounted on the side wall portion; the cooling fan includes a fan casing mounted on the side wall portion and an impeller that is housed in the fan casing and rotates to make an airflow flow into the casing from outside the main body housing portion; and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the board; and a third blow-out opening for blowing out part of the airflow flowing into the casing from the air inflow opening to the another board.

According to this structure, it is possible to cool a high-voltage board by means of the airflow blown out from the third blow-out opening of the fan casing. Therefore, it is unnecessary to additionally dispose a cooling fan for cooling the high-voltage board and dispose a long duct for guiding the airflow to the high-voltage board. Therefore, it is possible to improve the cooling efficiency and achieve the low cost.

It is preferable that the board is a power source board and the another board is a high-voltage board.

According to this structure, it is possible to efficiently cool the high-voltage board and the power source board.

The above board is the power source board, and the image forming device further includes: the high-voltage board for supplying a high voltage to the image forming portion; a main board that controls operation of the image forming device; and an engine board that controls operation of an actuator which includes the cooling fan. And, it is preferable that the power source board, the high-voltage board, the main board, and the engine board are all mounted on the side wall portion; and the cooling fan is configured to cool the image forming portion, the power source board as the board, the high-voltage board, the main board, and the engine board by means of an airflow generated by rotation of the cooling fan.

According to this structure, it is possible to dispose the cooling fan near heat source devices (portions to be cooled) such as the boards, the image forming portion and the like that need to be cooled. Accordingly, it is unnecessary to dispose the conventional long duct for cooling each board and the image forming portion. Therefore, it is possible to improve the cooling efficiency and achieve the low cost.

The cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the power source board, the main board and the engine board; and a third blow-out opening for blowing out part of the airflow flowing into the casing from the air inflow opening to the high-voltage board. In this way, it is possible to improve the cooling efficiency for the boards, the image forming portion and the like as soon as possible.

Advantageous Effects of Invention

According to the present disclosure, it is possible to efficiently cool the image forming portion ad the boards by means of an inexpensive structure.

DESCRIPTION OF EMBODIMENTS

Embodiment

Figure 1:
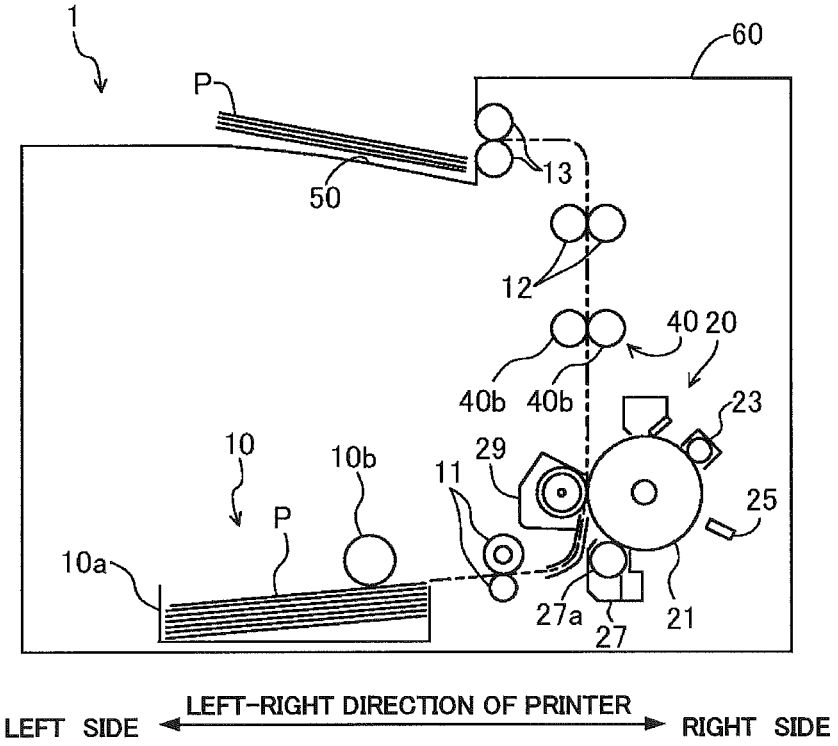
FIG. 1 is a schematic cross-sectional view when seeing, from a front side, a laser printer as an image forming device according to an embodiment.

FIG. 1 shows a laser printer 1 (hereinafter, simply called a printer) as an image forming device according to the present embodiment. This printer 1 has a paper sheet feeding portion 10, an image forming portion 20, a fixing portion 40, a sheet delivery portion 50, and a housing 60. A sheet conveyance route extending from the sheet feeding portion 10 to the sheet delivery portion 50 is provided with a plurality of conveyance roller pairs 11-13 that sandwich and convey a sheet P. In the meantime, in the description performed below, a side before the paper surface of FIG. 1 and a side behind the paper surface of FIG. 1 are respectively called a "front side" and a "rear side," and a left side of the paper surface of FIG. 1 and a right side of the paper surface of FIG. 1 are respectively called a "left side" and a "right side."

The sheet feeding portion 10 is disposed in a lower portion in the housing 60. The sheet feeding portion 10 has a sheet feeding cassette 10*a* in which the sheets P are housed and a pick-up roller 10*b* that takes out the sheet P in the sheet feeding cassette 10*a* and sends the sheet P to outside the cassette. The sheet P sent out from the sheet feeding cassette 10*a* to outside the cassette is supplied to the image forming portion 20 via the conveyance roller pair 11.

The image forming portion 20 includes a photosensitive drum 21, a charging device 23, a light exposure device 25, a developing device 27, a transfer device 29, and a toner container (not shown). After a circumferential surface of the photosensitive drum 21 is electrified by the charging device 23, laser light based on document image data (e.g., image data of document image received from an external terminal) is directed to a surface of the photosensitive drum 21 by the light exposure device 25, so that the image forming portion 20 forms an electrostatic latent image. The electrostatic latent image formed (carried) on the surface of the photosensitive drum 21 is developed as a toner image by the developing device 27. And, the image forming portion 20 uses the transfer device 29 to transfer the toner image onto the sheet P supplied from the sheet feeding portion 10 and supplies the sheet P after the transfer to the fixing portion 40.

At the fixing portion 40, the sheet P supplied from the image forming portion 20 is pressed between a fixing roller 40*a* and a pressure roller 40*b*, whereby the toner image is fixed onto the sheet P. And, the sheet P, on which the toner image is fixed by the fixing portion 40, is sent out to a downstream side by both rollers 40*a*, 40*b*. The sheet P sent out by the fixing portion 40 is delivered to the sheet delivery portion 50 via the plurality of conveyance roller pairs 12, 13. The sheet delivery portion 50 is formed by recessing an upper surface portion of the housing 60 in to a recessed shape.

Figure 2:
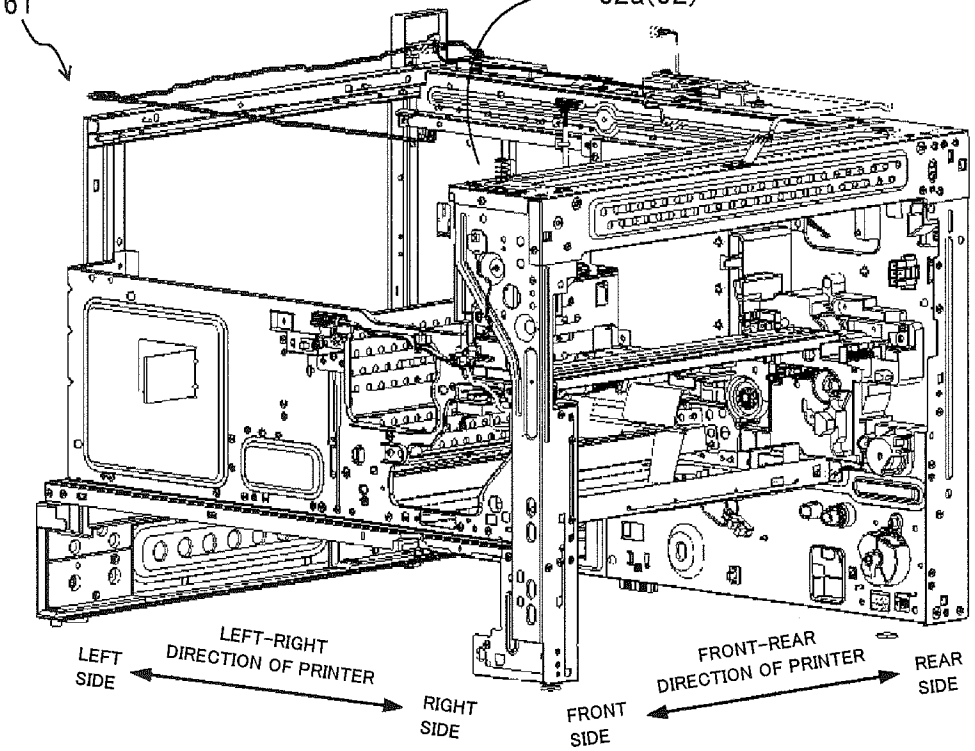
FIG. 2 is a perspective view when seeing a frame of a housing from a diagonally front right side.
Figure 3:
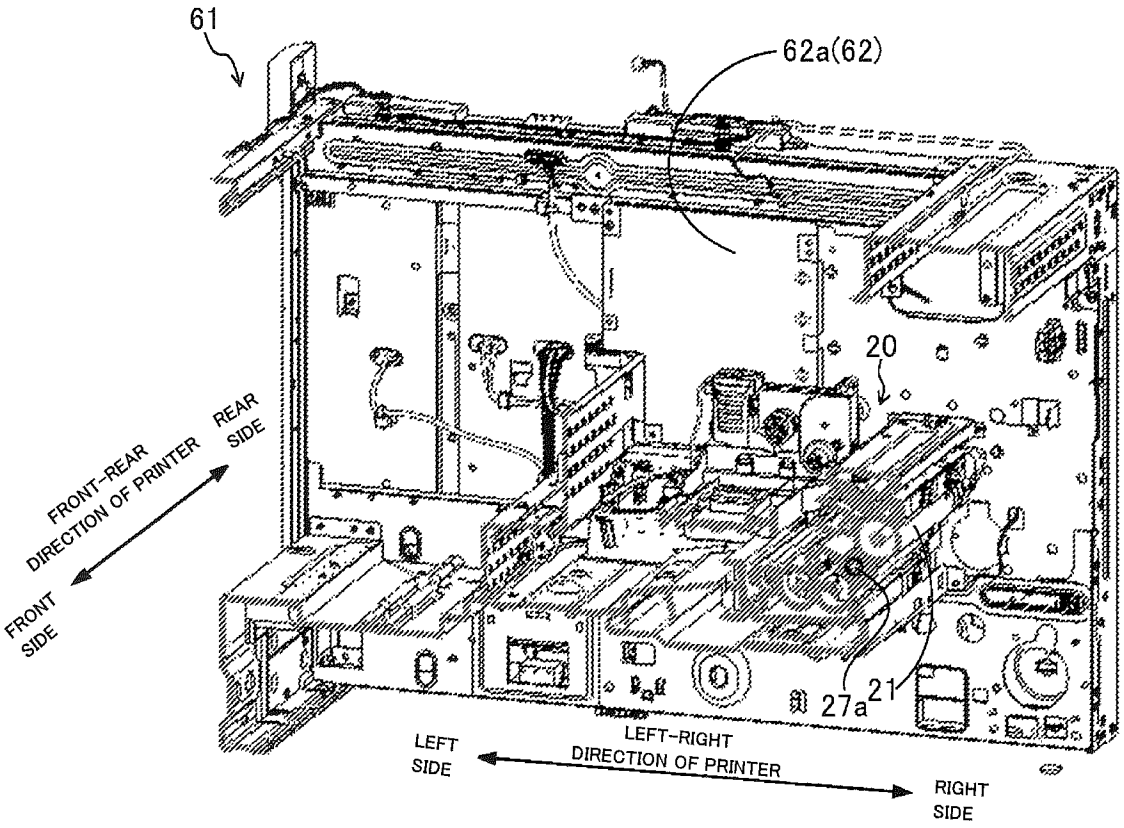
FIG. 3 is a perspective view when seeing an image forming portion housed in a housing from a diagonally front right side.
Figure 4:
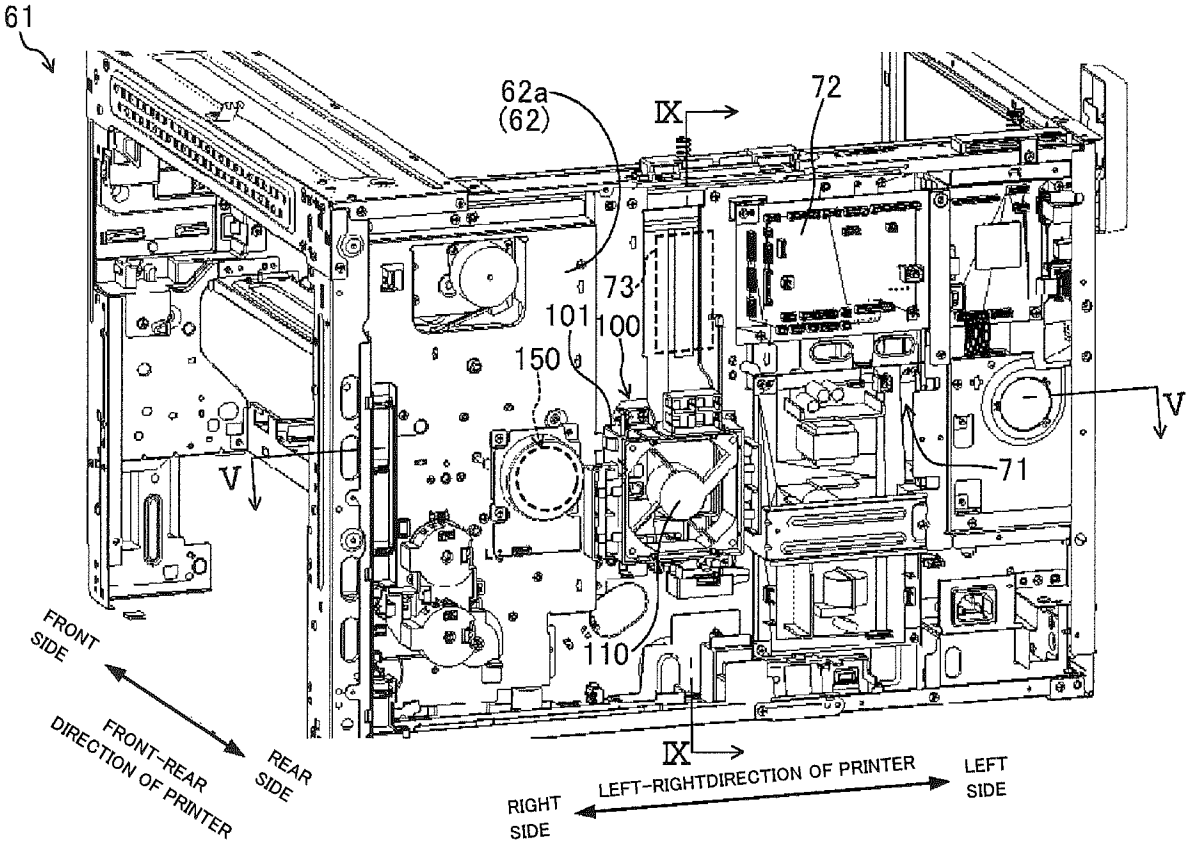
FIG. 4 is a perspective view when seeing a housing from a rear side.

The housing 60 has a frame 61 (see FIG. 2-FIG. 4) and a sheet metal 62. The housing 60 has a substantially rectangular-parallelepiped shape as a whole, and the frame 61 forms a skeleton. The sheet metals 62 are disposed to the number of 6 in all, and each sheet metal 62 forms one of a front wall portion, rear wall portion, left wall portion, right wall portion, upper wall portion, and lower wall portion of the housing 60. FIG. 2-FIG. 4 show only a sheet metal (hereinafter, called a rear sheet metal) 62*a* that forms the rear wall portion of the housing 60.

Figure 5:
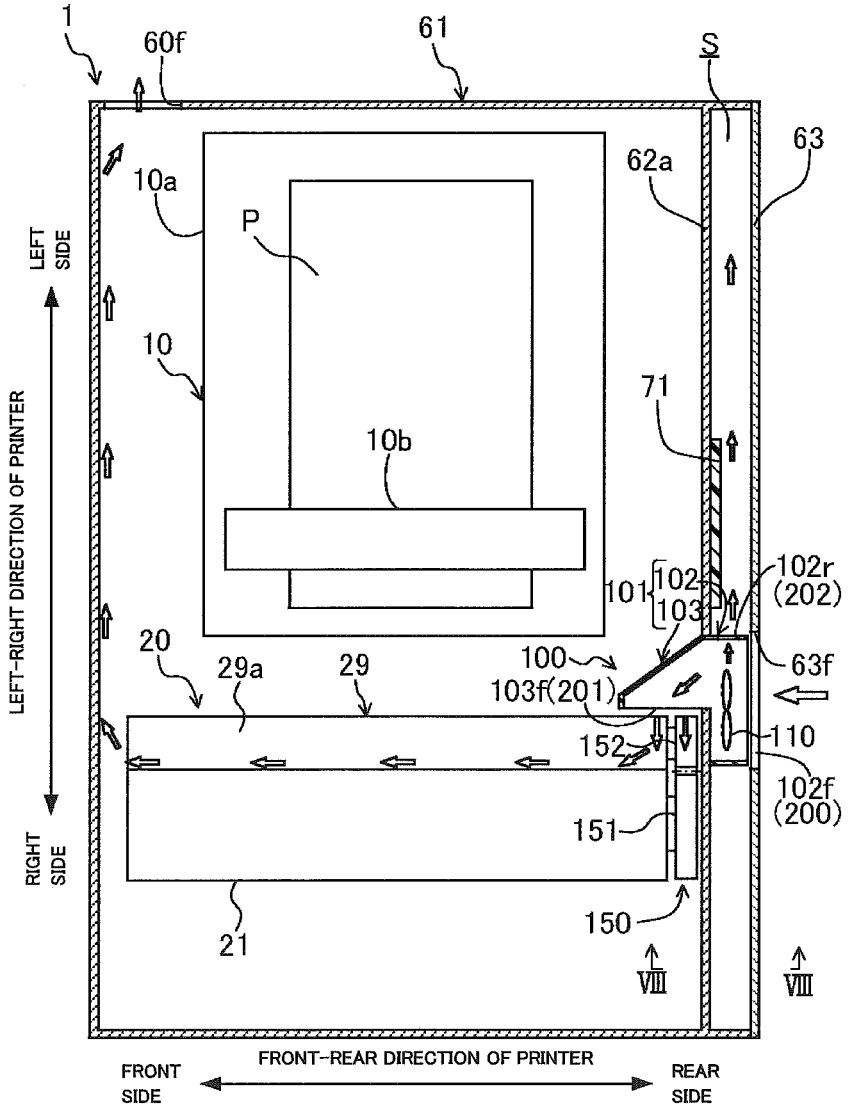
FIG. 5 is a schematic cross-sectional view cut along a V-V line of FIG. 4.

As shown in FIG. 5, the rear sheet metal 62*a* is disposed adjacently to the photosensitive drum 21 that is a constituent element of the image forming portion 20. The rear sheet metal 62*a* is located near one side in a shaft center direction of the photosensitive drum 21. One end portion in the shaft center direction of the photosensitive drum 21 is connected to a drive mechanism 150 for driving the drum 21. The drive mechanism 150 has a drive gear 151 connected to the photosensitive drum 21 in an integrally rotatable manner and a driven gear 152 connected to a transfer roller 29*a* of the transfer device 29 in an integrally rotatable manner. The driven gear 152 meshes with the drive gear 151. And, when the driven pear 152 is driven by a not-shown motor, the photosensitive drum 21 rotates together with the drive gear 151, and the transfer roller 29*a* rotates together with the driven gear 151.

The rear sheet metal 62*a* is covered by the outer cover 63 from outside the printer 1. The outer cover 63 is fixed to the frame 61 by a not-shown bolt. The outer cover 63 is disposed backward from the rear sheet metal 62*a* a predetermined distance away from the rear sheet metal 62*a*. In this way, a space (gap) S having a thickness in a front-rear direction is formed between the outer cover 63 and the rear sheet metal 62*a*. The outer cover 63 is provided with an air inhaling opening 63*f*. The air inhaling opening 63*f* is formed through a portion of the outer cover 63 near a rear side of a cooling fan 100 (described later). The left wall portion of the housing 60 is provided with an air exhaust opening 60*f* for discharging air in the housing 60 to outside. The air exhaust opening 60*f* is formed through a front lower end portion of the left wall portion of the housing 60.

Back to FIG. 4, the rear sheet metal 62*a* is provided thereon with a power source board 71, an engine■main board 72, a high-voltage board 73 (see FIG. 9), and the cooling fan 100.

The cooling fan 100 is disposed at a position of the rear sheet metal 62*a* located slightly left from an extended position in the shaft center direction of the photosensitive drum 21. The cooling fan 100 is configured to cool the image forming portion 20 and each of the boards 71-73 by means of an airflow generated by rotation of the cooling fan 100. Details of the cooling fan 100 are described later.

The power source board 71 is mounted on a portion of a rear surface of the rear sheet metal 62*a* on the left side of the cooling fan 100. The power source board 71 supplies necessary electric power to each of devices of the printer 1 such as a heater incorporated in the fixing roller 40*a*, a motor for driving the photosensitive drum 21 and the like.

The engine■main board 72 is mounted above the power source board 71 on the rear surface of the rear sheet metal 62*a*. The engine■main board 72 has both a function as an engine board that controls an actuator (in detail, a drive motor for the cooling fan 100, a drive motor for a conveyance system and the like) which includes the cooling fan 100 and a function as a main board that controls operation of the image forming portion 20.

The high-voltage board 73 is mounted on a front surface of the rear sheet metal 62*a*. The high-voltage board 73 is located slightly above a height position of an upper end surface of the cooling fan 100. The high-voltage board 73 supplies a high voltage to the transfer device 29, the developing device 27, the photosensitive drum 21 and the like.

Figure 6:
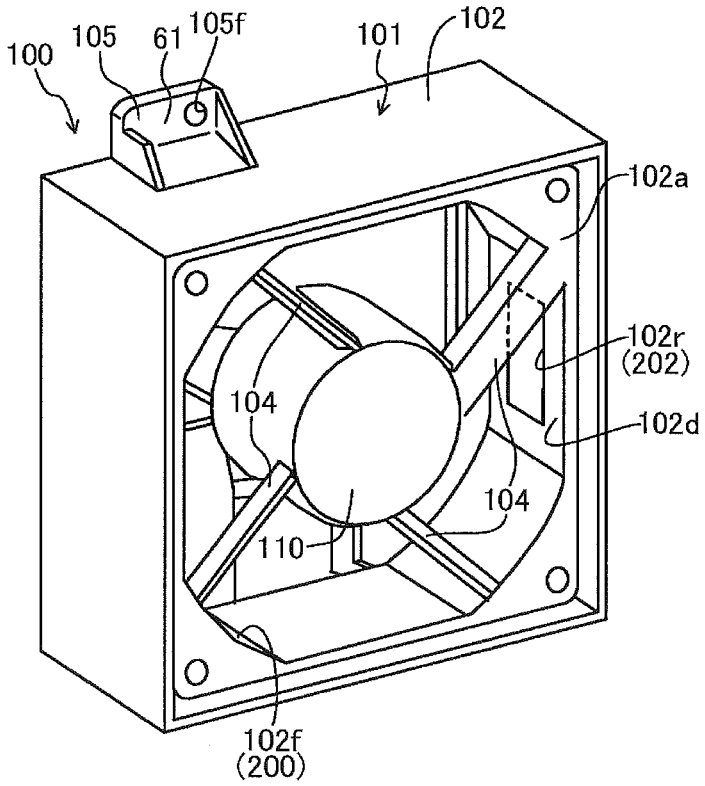
FIG. 6 is a perspective view when seeing a cooling fan from a front side (air inflow side).
Figure 7:
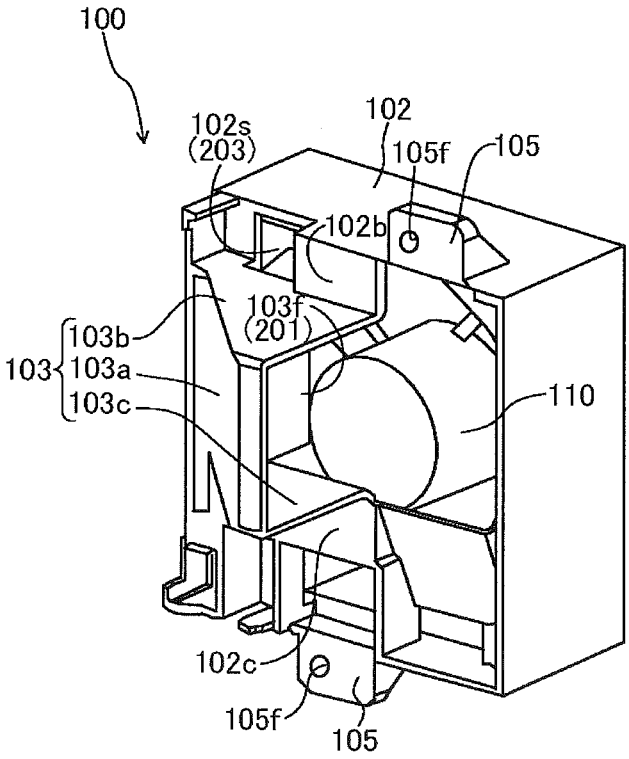
FIG. 7 is a perspective view when seeing a cooling fan from a rear side.

As shown in FIG. 5-FIG. 7, the cooling fan 100 has a fan casing 101 and an impeller 110. In the meantime, in the description performed below, unless otherwise specified, the description is performed on condition that the cooling fan 100 is mounted on the rear sheet metal 62*a* (in the state of FIG. 5).

The fan casing 101 has a rectangular main body casing 102 for housing the impeller 110, and a duct portion 103 integrally formed with the main body casing 102. The impeller 110 is rotatably supported on the main body casing 102 by four support portions 104 that extend outward in a radial direction from an outer circumferential portion of the impeller 110. The impeller 110 is driven to rotate by a not-shown motor.

An upper surface and lower surface of the main body casing 102 are each provided with a fixing bracket portion 105 (see FIG. 7). Each fixing bracket portion 105 is provided with a through-hole 105*f* that penetrates in a thickness direction of the fixing bracket portion 105. The main body casing 102 is fixed to the rear sheet metal 62*a* by a not-shown bolt inserted in the through-hole 105*f*.

A rear wall portion 102*a* of the main body casing 102 is provided with a through-hole 102*f* (see FIG. 6). The through-hole 102*f* is formed through an entirety except for four corners of the rear wall portion 102*a*. The through-hole 102*f* composes an air inflow opening 200 for allowing an airflow to flow into the fan casing 101. A left wall portion 102*d* of the main body casing 102 is provided with a rectangular opening portion 102*r* that penetrates in a thickness direction. The opening portion 102*r* composes a second blow-out opening 202 for blowing out part of the airflow, which flows from the air inflow opening 200 into the fan casing 101, to the power source board 71 and the engine■main board 72.

The duct portion 103 is connected to a front side of the main body casing 102 and penetrates the rear sheet metal 62*a* (see FIG. 5). The duct portion 103 has an inclination wall portion 103*a* that inclines rightward (toward the photosensitive drum 21) from a front portion to a rear portion (see FIG. 7). An upper end edge of the inclination wall portion 103*a* is connected to an upper wall portion 103*b* and a lower end edge of the inclination wall portion 103*a* is connected to a lower wall portion 103*c*. The upper wall portion 103*b* and the lower wall portion 103*c* are horizontally disposed to oppose each other. The upper wall portion 103*b* and the lower wall portion 103*c* are respectively connected to an upper vertical wall portion 102*b* and a lower vertical wall portion 102*c* that compose a portion of the main body casing 102.

A downstream-side opening portion 103*f* of the duct portion 103 is opened near one end portion in the shaft center direction of the photosensitive drum 21. And, the opening portion 103*f* composes a first blow-out opening 201 that blows out part of the airflow, which flows from the air inflow opening 200 into the fan casing 101, to the one end portion in the shaft center direction of the photosensitive drum 21.

The upper vertical wall portion 102*b* is provided with a substantially square-shaped opening portion 102*s* that penetrates in a thickness direction. The opening portion 102*s* is connected to a through-hole 62*f* (see FIG. 9) that is formed near a lower side of the high-voltage board 73 on the rear sheet metal 62*a*. And, the opening portion 102*s* composes a third blow-out opening 203 for blowing out part of the airflow, which flows from the air inflow opening 200 into the fan casing 101, to the high-voltage board 73.

In the printer 1 composed as described above, when the cooling fan 100 is driven, air outside the printer 1 is guided into the cooling fan 100 via the air inhaling opening 63*f* formed through the outer cover 63 (see FIG. 5). And, an airflow flows into the casing 101 via the air inflow opening 200 formed through the fan casing 101. The airflow flowing into the fan casing 101 roughly separates into three airflows of: an airflow blown out from the first blow-out opening 201; an airflow blown out from the second blow-out opening 202; and an airflow blown out from the third blow-out opening 203 (see FIG. 9).

Figure 8:
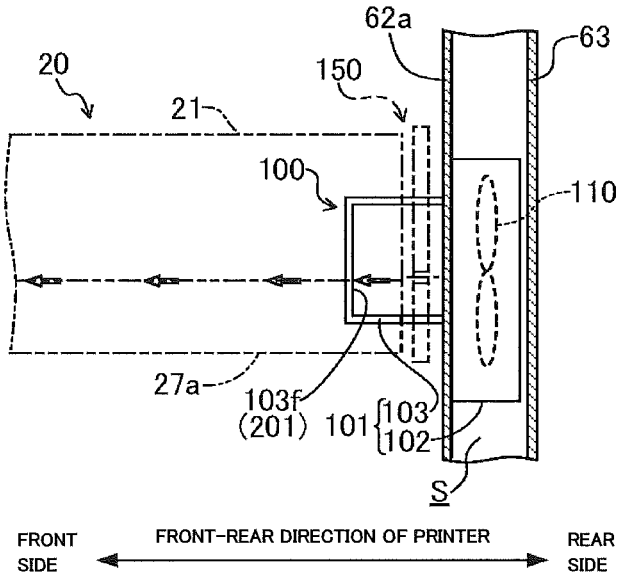
FIG. 8 is a schematic cross-sectional view cut along a VIII-VIII line of FIG. 5.

As indicated by an outline arrow in FIG. 5 and FIG. 8, the airflow blown out from the first blow-out opening 201 is blown out to the one end portion in the shaft center direction of the photosensitive drum 21. Thereafter, the airflow flows from the one end to the other end (from the rear side to the front side) in the shaft center direction along a boundary portion between the photosensitive drum 21 and the developing roller 27*a* (see FIG. 8), thereafter, flows from the right side to the left side along the front wall portion of the housing 60 to be discharged from the exhaust opening 60*f*. In this way, the entire image forming portion 20 including the photosensitive drum 21 is cooled by the airflow discharged from the first blow-out opening 201. Accordingly, it is possible to prevent the image forming portion 20 from being excessively heated by heat from the fixing portion 40 adjacent to the image forming portion 20 and prevent the image forming portion 20 from being excessively heated by operation of the light exposure device 25.

As indicated by an outline arrow in FIG. 5, the airflow blown out from the second blow-out opening 202 flows from the right side to the left side along the rear sheet metal 62*a*, passes the power source board 71, thereafter, is discharged from a not-shown exhaust opening to outside the printer 1. Because the engine■main board 72 is disposed above the power source board 71, besides the power source board 71, the engine■main board 72 is cooled by the airflow. Accordingly, it is possible to prevent the power source board 71 and the engine main board 72 from excessively generating heat to malfunction.

Figure 9:
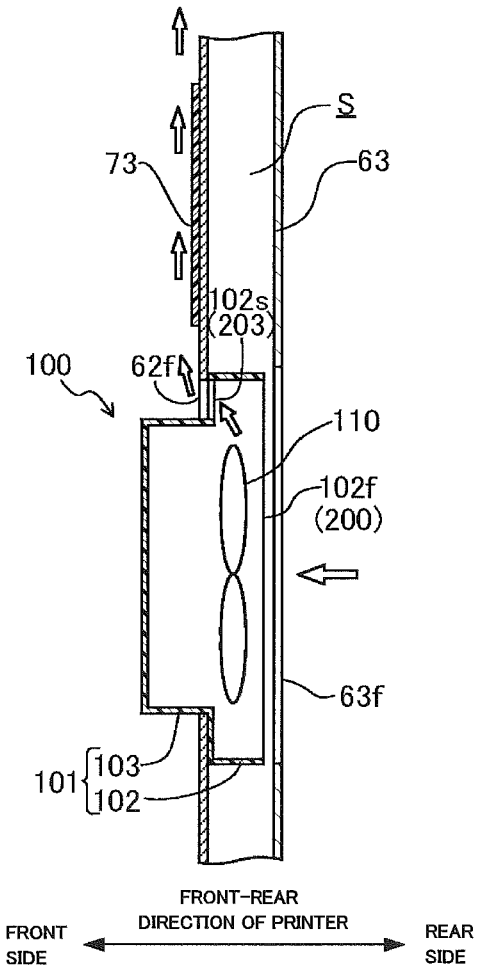
FIG. 9 is a schematic cross-sectional view cut along a IX-IX line of FIG. 4.

As indicated by an outline arrow in FIG. 9, the airflow blown out from the third blow-out opening 203 flows from the lower side to the upper side along the rear sheet metal 62*a*, passes the high-voltage board 73, thereafter, is discharged from the exhaust opening 60*f* to outside the printer 1. In this way, the high-voltage board 73 is cooled by the airflow. Accordingly, it is possible to prevent the high-voltage board 73 from malfunctioning because of excessive heat generation.

As described above, in the above embodiment, all the boards 71-73 are mounted on the rear sheet metal 62*a* adjacent to the image forming portion 20, and the cooling fan 100 is mounted on the rear sheet metal 62*a*. Besides, the drive mechanism 150 of the photosensitive drum 21, which is a constituent element of the image forming portion 20, is disposed near the rear sheet metal 62*a*. In this way, it is possible to gather and dispose the heat sources such as the boards 71-73, the image forming portion 20, the drive mechanism 150 and the like in a rear portion of the printer 1 and to dispose the cooling fan 100 at the place near the heat sources.

Accordingly, it is unnecessary to dispose a long duct to cool the heat sources such as the boards 71-73, the image forming portion 20, the drive mechanism 150 and the like. Therefore, it is possible to efficiently cool the heat sources (places to be cooled) by means of an inexpensive structure. Besides, it is also unnecessary to increase the number of cooling fans 100 to cool each board 71-73, the image forming portion and the drive mechanism 150. Accordingly, it is possible to reduce the fan noise and the production cost.

Besides, in the above embodiment, the cooling fan 100, the power source board 71, and the engine■main board 72 are mounted on the surface (rear side) of the rear sheet metal 62*a* near the outer cover 63.

Accordingly, an operator can easily gain access to the cooling fan 100, the power source board 71, and the engine■main board 72 by only removing the outer cover 63. Therefore, it is possible to improve maintenance characteristics of these devices.

Other Embodiments

The present disclosure is not limited to the above embodiment.

In other words, in the above embodiment, the engine board and the main board are unified as the engine■main board 72. However, this is not limiting, but both boards may be separated.

In the above embodiment, as an example of the image forming device, the laser printer 1 of electro-photographic type is described. However, this is not limiting. In other words, the image forming device may be an image forming device of ink jet type, for example.

In the above embodiment, only one cooling fan 100 is disposed. However, this is not limiting, but a plurality of the cooling fans 100 may be disposed.

INDUSTRIAL APPLICABILITY

As described above, the present disclosure is useful for an image forming device, especially useful for an image forming device that includes: a main body housing portion which houses an image forming portion that records an image onto a sheet; a power source board; and a cooling fan for cooling the image forming portion and the power source board.

REFERENCE SIGNS LIST

1 laser printer (image forming device)
20 image forming portion
21 photosensitive drum
60 housing (main body housing portion)
62*a* rear sheet metal (side wall portion)
63 outer cover
63*f* air inhaling opening
71 power source board (one board)
72 engine■main board (engine board, main board)
73 high-voltage board (another board)
100 cooling fan
101 fan casing
110 impeller
150 drive mechanism
200 air inflow opening
201 first blow-out opening
202 second blow-out opening
203 third blow-out opening

The invention claimed is:

1. An image forming device comprising;

a main body housing portion that houses an image forming portion which records an image onto a sheet, a board that is mounted on a side wall portion adjacent to the image forming portion in the main body housing portion, a cooling fan that is mounted on a side wall portion adjacent to the image forming portion in the main body housing portion and configured to cool the image forming portion and the board by means of an airflow generated by rotation, and an outer cover that covers the side wall portion from outside the image forming device and is provided with an air inhaling portion, wherein a gap is formed between the side wall portion and the outer cover, and the board and the cooling fan are mounted on a surface of the side wall portion near the outer cover.

2. The image forming device according to claim 1, wherein the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; and a second blow-out opening for blowing out part of the airflow flowing into the casing from the air inflow opening to the board.

3. The image forming device according to claim 2, comprising:

a duct portion the first blow-out opening of which directs the airflow to the image forming portion.

4. The image forming device according to claim 2, wherein the image forming portion includes a photosensitive drum that carries an electrostatic latent image, the side wall portion is located in one side in a shaft direction of the photosensitive drum in the main body housing portion, and the first blow-out opening of the fan casing is configured to blow out part of the airflow flowing into the casing from the air inflow opening to one end portion in the shaft direction of the photosensitive drum.

5. The image forming device according to claim 4, wherein the one end portion in the shaft direction of the photosensitive drum is connected to a drive mechanism for driving the photosensitive drum.

6. The image forming device according to claim 1, wherein the board is a power source board, the image forming device further comprising: a high-voltage board for supplying a high voltage to the image forming portion, a main board that controls operation of the image forming device, and an engine board that controls operation of an actuator which includes the cooling fan, wherein the power source board, the high-voltage board, the main board, and the engine board are all mounted on the side wall portion, and the cooling fan is configured to cool the image forming portion, the power source board as the board, the high-voltage board, the main board, and the engine board by means of an airflow generated by rotation of the cooling fan.

7. The image forming device according to claim 6, wherein the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the power source board, the main board and the engine board; and a third blow-out opening for blowing out part of the airflow flowing into the casing from the air inflow opening to the high-voltage board.

8. An image forming device comprising;

a main body housing portion that houses an image forming portion which records an image onto a sheet, a board that is mounted on a side wall portion adjacent to the image forming portion in the main body housing portion, a cooling fan that is mounted on a side wall portion adjacent to the image forming portion in the main body housing portion and configured to cool the image forming portion and the board by means of an airflow generated by rotation, another board for supplying a high voltage to the image forming portion, wherein the another board is mounted on the side wall portion, the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the board; and a third blow-out opening for blowing out part of the airflow flowing into the casing from the air inflow opening to the another board.

9. The image forming device according to claim 8, wherein the board is a power source board and the another board is a high-voltage board.

10. The image forming device according to claim 8, wherein the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; and a second blow-out opening for blowing out part of the airflow flowing into the casing from the air inflow opening to the board.

11. The image forming device according to claim 10, comprising:

a duct portion the first blow-out opening of which directs the airflow to the image forming portion.

12. The image forming device according to claim 10, wherein the image forming portion includes a photosensitive drum that carries an electrostatic latent image, the side wall portion is located in one side in a shaft direction of the photosensitive drum in the main body housing portion, and the first blow-out opening of the fan casing is configured to blow out part of the airflow flowing into the casing from the air inflow opening to one end portion in the shaft direction of the photosensitive drum.

13. The image forming device according to claim 8, wherein the board is a power source board, the image forming device further comprising: a high-voltage board for supplying a high voltage to the image forming portion, a main board that controls operation of the image forming device, and an engine board that controls operation of an actuator which includes the cooling fan, wherein the power source board, the high-voltage board, the main board, and the engine board are all mounted on the side wall portion, and the cooling fan is configured to cool the image forming portion, the power source board as the board, the high-voltage board, the main board, and the engine board by means of an airflow generated by rotation of the cooling fan.

14. The image forming device according to claim 13, wherein the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the power source board, the main board and the engine board;

and a third blow-out opening for blowing out part of the airflow flowing into the casing from the air inflow opening to the high-voltage board.

15. An image forming device comprising;

a main body housing portion that houses an image forming portion which records an image onto a sheet, a board that is mounted on a side wall portion adjacent to the image forming portion in the main body housing portion, a cooling fan that is mounted on a side wall portion adjacent to the image forming portion in the main body housing portion and configured to cool the image forming portion and the board by means of an airflow generated by rotation, wherein the board is a power source board, the image forming device further comprising: a high-voltage board for supplying a high voltage to the image forming portion, a main board that controls operation of the image forming device, and an engine board that controls operation of an actuator which includes the cooling fan, the power source board, the high-voltage board, the main board, and the engine board are all mounted on the side wall portion, the cooling fan is configured to cool the image forming portion, the power source board as the board, the high-voltage board, the main board, and the engine board by means of an airflow generated by rotation of the cooling fan, the cooling fan includes a fan casing mounted on the side wall portion and an impeller that is housed in the fan casing and rotates to make an airflow flow into the casing from outside the main body housing portion, and the fan casing includes: an air inflow opening; a first blow-out opening for blowing out part of the airflow flowing into the casing from the air inflow opening to the image forming portion; a second blow-out opening for blowing out part of the airflow flowing into the casing from the air inflow opening to the power source board, the main board and the engine board; and a third blow-out opening for blowing out part of the airflow flowing into the casing from the air inflow opening to the high-voltage board.

* * * * *